United States Patent [19]

Kitayama

[11] 4,315,196

[45] Feb. 9, 1982

[54] DISCONNECTION DETECTING CIRCUIT OF DOUBLE-FILAMENT SPHERICAL LAMP

[75] Inventor: Fujio Kitayama, Omoriniski, Japan

[73] Assignee: Niles Parts Company, Ltd., Tokyo, Japan

[21] Appl. No.: 107,851

[22] Filed: Dec. 28, 1979

[30] Foreign Application Priority Data

Apr. 12, 1979 [JP] Japan ..... 54-44673

[51] Int. Cl.[3] ..... H05B 39/00; H05B 37/03

[52] U.S. Cl. ..... 315/132; 315/64; 315/135; 315/136

[58] Field of Search ..... 315/129–132, 315/135, 136, 82, 83, 64; 340/642

[56] References Cited

U.S. PATENT DOCUMENTS 3,735,378 5/1973 McNamee ..... 315/129 X

*Primary Examiner*—Eugene R. LaRoche

*Attorney, Agent, or Firm*—Stephen F. K. Yee

[57] ABSTRACT

A fault detection apparatus for use with a double-filament lamp utilizes the temperature-related changes in resistance of the non-energized filament to indicate a break in the energized filament. The circuit of the apparatus includes, for each filament, a first voltage dividing network in parallel with the filament and which includes the other filament as a voltage dividing resistance and a second voltage dividing network including the filament which establishes a reference voltage. A comparator is activated to energize a warning lamp when the sensed voltage at a specific voltage dividing point in the network is changed due to the temperature-related changes in the resistance value of the non-energized filament when the energized filament is broken.

2 Claims, 4 Drawing Figures

DISCONNECTION DETECTING CIRCUIT OF DOUBLE-FILAMENT SPHERICAL LAMP

BACKGROUND OF THE INVENTION

1. Field of the Invention

This invention relates generally to electrical fault detectors, and is more particularly directed to a novel fault detecting circuit for a double-filament lamp which is capable of discriminating a break in one of the filaments according to a variation in the remaining filament's resistance values due to a change in temperature coefficient of resistance when one filament is broken.

2. Description of the Prior Art

Heretofore, there has been no apparatus available which can detect a filament break in a double-filament lamp by sensing the variation in resistance values due to changes in the temperature coefficient of resistance of the filaments when one of the filaments is broken.

In an example filament break or disconnection detecting circuit 1 of a prior art device shown in FIG. 1, for instance, the input portion of a first comparator 4 is connected to both ends of a detecting resistor 3 inserted and connected in series with one filament 2*a* of a double-filament lamp 2. Similarly, the input portion of a second comparator 6 is connected to both ends of a detecting resistor 5 inserted and connected in series with the other filament 2*b* of the double-filament lamp 2. A break in either filament 2*a* or 2*b* results in a voltage drop across the respective resistor 3 or 5 which is sensed by the respective comparator 4 or 6 to activate a warning lamp 7 or 8.

However, it would be inconvenient and cumbersome to insert and connect a detecting resistor such as resistor 3 or 5 in series with the filaments 2*a* and 2*b* of the aforesaid double-filament lamp 2. In addition, there is the disadvantage that an adequate intensity of illumination of the double-filament lamp 2 may not be assured due to the voltage drop caused by the detecting resistors 3 and 5.

SUMMARY OF THE INVENTION

An object of this invention is to overcome the disadvantages inherent in the above-discussed type of prior art detecting circuits, and to provide a fault detecting circuit for a double-filament lamp which may simply be connected in parallel with the current carrying circuit of the lamp and discriminates a break in either filaments without affecting the illumination intensity of the lamp.

It is a principal object of the present invention to provide a novel fault detection apparatus for a double-filament lamp which discriminates a break in the filaments according to variations in resistance values of the filaments based on changes in the filaments' temperature coefficient of resistance when the lamp temperature is altered by a filament break.

It is another object of the present invention to provide a novel fault detection apparatus for a double-filament lamp which is substantially free of voltage drop due to detecting resistors connected in series with the lamp filaments.

It is another object of the present invention to provide a fault detection apparatus for a double-filament lamp which discriminates a filament break in the lamp by applying an electric potential at the voltage dividing point of a voltage dividing circuit to the input terminal of a comparator in the circuit.

It is a further object of the present invention to provide a fault detection apparatus for a double-filament lamp wherein current directivity has been made more efficient or simpler with diodes in the respective voltage dividing circuits.

It is still a further object of the present invention to provide a fault detection apparatus for a double-filament lamp characterized in that the fault detecting circuit is of simple construction with electrical elements.

It is another object of the present invention to provide a fault detection apparatus for a double-filament lamp in which the detecting circuit is constructed of integrated circuits (IC).

The fault detecting circuit of this invention discriminates a break in the lamp filaments of a double-filament lamp by sensing any changes in the resistance value of the unbroken filament due to variations in its temperature coefficient of resistance. When one filament in a double-filament lamp is energized and both filaments are unbroken, a certain temperature exists and the resistance of the non-energized filament has a specific value. However, if the energized filament is broken, the temperature in the lamp is lowered and the resistance in the remaining filament is altered due to its temperature-dependent coefficient of resistance. The present invention utilizes this change in filament resistance value due to temperature changes in the lamp to detect a break in the filament.

BRIEF DESCRIPTION OF THE DRAWINGS

The objects, features and advantages of the present invention can be understood from the above description, and to make them still clearer herein, the presently preferred embodiments are shown in the drawings.

DESCRIPTION OF THE PREFERRED EMBODIMENTS

Figure 1:
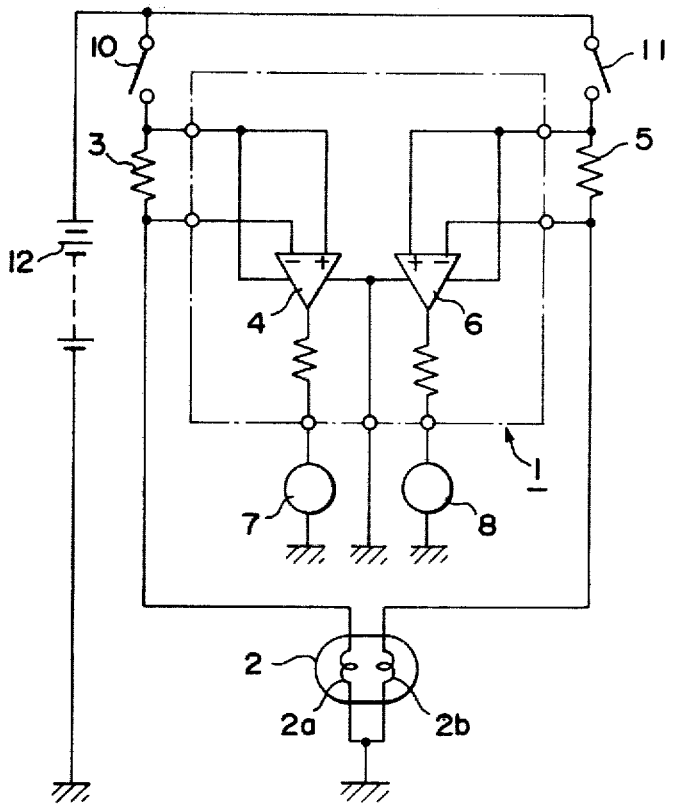
FIG. 1 PRIOR ART
FIG. 1 is a wiring diagram of a fault detecting circuit of the prior art for a double-filament lamp.
Figure 2:
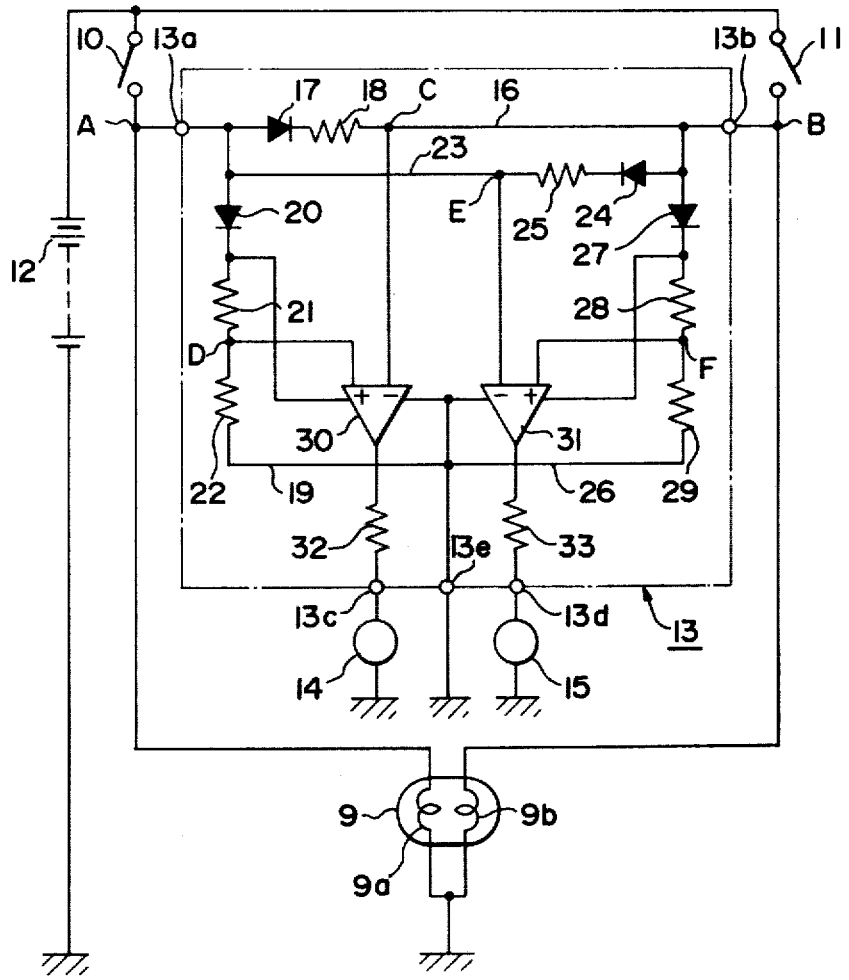
FIG. 2 is a wiring diagram of one embodiment of a fault detection circuit for a double-filament lamp according to the present invention.
Figure 3:
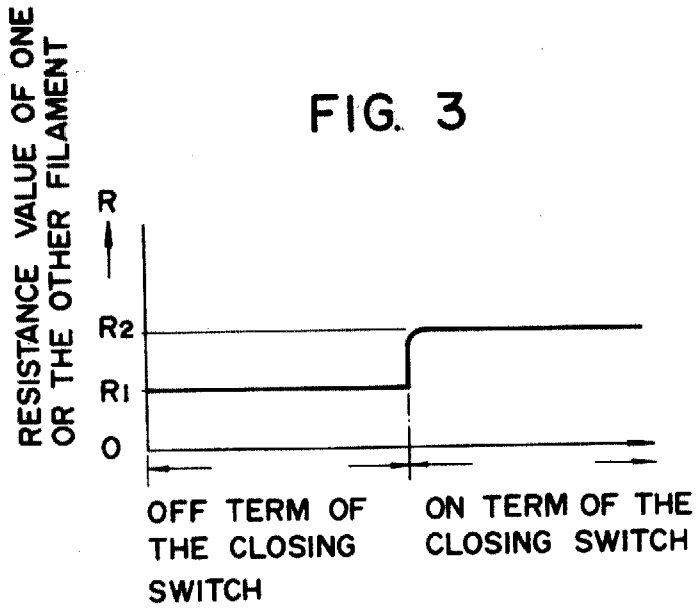
FIG. 3 is a diagrammatic representation of the variation in resistance value of a filament in a double-filament lamp at the time when a switch is turned on and off.

FIG. 2 and FIG. 3 show one embodiment of the present invention. A double-filament lamp 9 has filaments 9*a* and 9*b* connected to a power source 12 through respective closing switches 10 and 11. A fault detection circuit shown generally by 13 has a first detecting terminal 13*a* connected to a detecting point A in the current circuit for the filament 9*a* and a second detecting terminal 13*b* connected to a detecting point B in the current circuit for the filament 9*b*. A first actuating terminal 13*c* of the fault detection circuit 13 is earthed or grounded via a first fault warning lamp 14 associated with the filament 9*a*. A second actuating terminal 13*d* is earthed through a fault warning lamp 15 associated with the filament 9*b*, and an earth terminal 13*e* is connected to earth or ground.

Pont C and point E in the fault detection circuit 13 are voltage dividing points provided in a branch circuit across the detecting terminals 13*a* and 13*b*. Point C is a voltage dividing point in a first voltage dividing circuit 16 incorporating a resistor 18 and the filament 9*b* as a voltage dividing resistor, while the point E is a voltage dividing point in a third voltage dividing circuit 23 having a resistor 25 and the filament 9a as a voltage dividing resistor. Diodes 17 and 24 are included in the circuits 16 and 23, respectively.

Similarly, point D and point F are voltage dividing points, with the former being set in a branch circuit across the detecting terminal 13a and the earth terminal 13e, and the latter being provided in a branch circuit across the detecting terminal 13b and the earth terminal 13e. Point D is a voltage dividing point in a second voltage dividing circuit 19 having resistors 21 and 22 as a voltage dividing resistor and a diode 20. Point F is a voltage dividing point in a fourth voltage dividing circuit 26 using resistors 28 and 29 as a voltage dividing resistor and including a diode 27.

A comparator 30 has a reversed input portion connected to the voltage dividing point C in the foregoing first voltage dividing circuit 16 and a non-reversed input portion connected to the voltage dividing point D in the aforesaid second voltage dividing circuit 19. A comparator 31 has a reversed input portion connected to the voltage dividing point E in the aforementioned third voltage dividing circuit 23 and a non-reversed input portion connected to the voltage dividing point F in the fourth voltage dividing circuit 26. The respective output portions of the comparators 30 and 31 are connected to the actuating terminals 13c and 13d via the resistors 32 and 33. The power terminal of comparator 30 is preferably connected across the detecting terminal 13a and the earth terminal 13e through the diode 20, and the power terminal of the comparator 31 is preferably connected across the detecting terminal 13b and the earth terminal 13e through the diode 27.

It can be seen from FIG. 2 and the foregoing description that the aforesaid second and fourth voltage dividing circuits 19 and 26, respectively, operate to provide a reference voltage for the comparators 30 and 31.

In operation and with both filaments 9a and 9b of the double-filament lamp 9 being normal (i.e., not broken or disconnected), when the closing switch 10 or 11 is turned on , the respective filament 9a or 9b is energized and heated to emanate a light. At the same time, the other or non-energized filament 9b or 9a is heated by the energized filament, with the result that the internal resistance value of the non-energized filament increases from $R_1$ to $R_2$ according to the temperature coefficient of resistance, as shown in FIG. 3. More particularly, when the closing switch 10 is turned on, for example, the filament 9a is energized to emit light and heat, and the filament 9b is heated by the heat produced by filament 9a, resulting in an increase in the resistance value of filament 9b, from $R_1$ to $R_2$ as viewed in FIG. 3. Consequently, the electric potential at the voltage dividing point C of the first voltage dividing circuit 16, which includes the filament 9b as a voltage dividing resistor, rises and the comparator 30 is placed in a non-reversed condition in which it fails to light the warning lamp 14. No light is emitted from the filament 9b due to the substantial voltage drop in the first voltage dividing circuit 16.

If the filament 9a is broken, then when the closing switch 10 is energized, the filament 9a fails to emit light or heat. The filament 9b is not heated and its internal resistance remains at a relatively low value $R_1$. Therefore, the electric potential at the voltage dividing point C in the first voltage dividing circuit 16 is low, and the comparator 30 makes a reversal to energize the warning lamp 14 to indicate that the filament 9a is broken. In this case, the filament 9b also fails to emit a light due to the substantial voltage drop in the first voltage dividing circuit 16.

In a similar manner, when the closing switch 11 is energized and so along as the filament 9b is normal, the electric potential at the voltage dividing point E in the third voltage dividing circuit 23 increases to place comparator 31 in a non-reversed condition and the warning lamp 15 is not energized. However, if the filament 9b is broken, the electric potential at the voltage dividing point E in the third voltage dividing circuit 23 is relatively low and the comparator 31 makes a reversal to light up the warning lamp 15 to indicate that the filament 9b is broken. With the closing switch 11 energized and the filament 9b broken, the filament 9a remains non-energized due to the substantial voltage drop in the third voltage dividing circuit 23.

Figure 4:
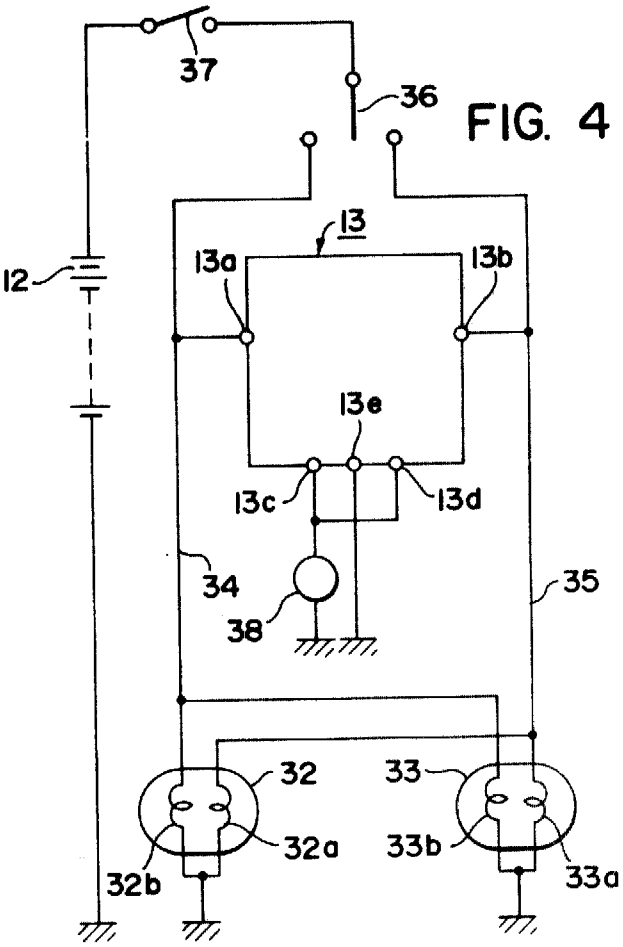
FIG. 4 is a wiring diagram of another embodiment of a fault detection circuit for a double-filament lamp according to the present invention.

FIG. 4 shows an embodiment of the fault detection circuit 13 of this invention connected to the current circuits of the left and right double-filament lamps 32 and 33 of an automobile. The left and right head lamps 32 and 33 have respective main filaments 32a and 33a and dimmer filaments 32b and 33b. A main current circuit 34 for the respective main filaments 32a and 33a and a dimmer current circuit 35 for the dimmer filaments 32b and 33b are preferably selected and formed by means of a selector switch 36 and a light switch 37. The main current circuit 34 is connected to the first detecting terminal 13a of the fault detection circuit 13, while the dimmer current circuit 35 is connected to the second detecting terminal 13b. At the same time, the actuating terminals 13c and 13d of the fault detection circuit 13 are earthed via a single warning lamp 8, and the earth terminal 13e is kept connected to earth. The construction of the fault detection circuit 13 in FIG. 4 is identical to the circuit described in FIG. 2.

The embodiment of FIG. 4 operates as follows. Upon operating the selected switch 36 to the main side for closing the circuit of the main filaments 32a and 33a, which are in the normal condition, the filaments 32a and 33a are energized to emit heat and light. The dimmer filaments 32b and 33b are heated by the main filaments 32a and 33a, resulting in an increase in their internal resistance values, placing the comparator 30 in the fault detection circuit 13 in its non-reversed condition to keep the warning lamp 38 unlit. When the selector switch 36 is turned to the main side for closing the circuit to the main filaments 32a and 32b, and if either main filament 32a or 33a is broken, then the respective dimmer filament 32b or 33b is not heated and its internal resistance value remains relatively low. The result is that comparator 30 in the fault detection circuit 13 makes a reversal and the warning lamp 38 is lit to indicate a break in the main filament 32a or 33a. Similarly, when the selector switch 36 is turned to close the circuit for the dimmer filaments 32b and 33b, and provided that these filaments are normal, the warning lamp 38 is not energized by the comparator 31. However, if either dimmer filament 32b or 33b is broken, then the comparator 31 makes reversal to turn on the warning lamp 38 in the manner described above relative to the main filaments 32a and 33a.

The fault detection apparatus of this invention is capable of discriminating breaks in various double-filament lamps used in automobiles, and offers the advantage of correctly detecting a broken filament by using the temperature-related change in the resistance value of the remaining, unbroken filament. The circuit has a relatively simple construction, and since it can be connected in parallel with the current circuits of the filaments in a double-filament lamp, it is easily connected to the lamp. Additionally, since no detecting resistor is placed in series with the current circuit of the filaments, the intensity of illumination of the lamp is not affected.

It is understood that various modifications can be made by those skilled in the art without departing from the invention as defined in the appended claims.

What is claimed is:

1. In combination with a double-filament lamp having a first and a second filament connected to a power source by respective circuits which include respective first and second control switches and an indicator device for indicating failure of either filament, an apparatus for detecting the failure of a filament in the lamp and activating said indicator, said apparatus comprising:

a first voltage-dividing circuit connected to said first filament circuit and said indicator which includes said second filament as a voltage-dividing resistor in said first voltage-dividing circuit;

a second voltage-dividing circuit connected to said second filament circuit and said indicator which includes said first filament as a voltage-dividing resistor in said second voltage-dividing circuit;

a first comparator connected to said voltage-dividing circuit and said indicator;

a second comparator connected to said second voltage-dividing circuit and said indicator;

a third voltage-dividing circuit connected to said first filament circuit and said first comparator for setting a reference voltage; and a fourth voltage-dividing circuit connected to said second filament circuit and said second comparator for setting a reference voltage;

whereby with both filaments intact the heat from the energization of either filament increases the resistance of the remaining filament to increase the voltage potential sensed by the comparator in the circuit of the energized filament to prevent activation of said indicator, and when an energized filament has failed the resistance of the remaining filament is not increased and the voltage potential sensed by the comparator in the circuit of the energized filament remains low to cause said comparator to activate said indicator to signal a failed filament, said respective third and fourth voltage-dividing circuits provide a voltage drop to prevent the non-energized filament from being energized should the energized filament fail.

2. The combination as defined in claim 1, further including a second indicator device connected to the output of said second comparator, with said indicator connected to the output of said first comparator.

* * * * *